US006168535B1

(12) United States Patent
Lu

(10) Patent No.: US 6,168,535 B1
(45) Date of Patent: Jan. 2, 2001

(54) BIO-RHYTHM BALANCED PUTTER

(76) Inventor: Clive S. Lu, 282 Newbridge Rd., Hicksville, NY (US) 11801

( * ) Notice: Under 35 U.S.C. 154(b), the term of this patent shall be extended for 0 days.

(21) Appl. No.: 09/270,206

(22) Filed: Mar. 15, 1999

(51) Int. Cl.[7] ..... A63B 53/00

(52) U.S. Cl. ..... 473/313; 473/314; 473/409; 73/65.03

(58) Field of Search ..... 473/305, 306, 473/307, 313, 314, 318, 324, 340, 409; 434/252; 73/65.03, 65.01

(56) References Cited

U.S. PATENT DOCUMENTS 1,703,199 * 2/1929 McClure .
3,625,517 * 12/1971 Durnack .
3,954,265 * 5/1976 Taylor .
4,073,492 * 2/1978 Taylor .
4,866,979 * 9/1989 Bernhardt .
5,228,332 * 7/1993 Bernhardt .
5,864,960 * 2/1999 Denicolo .

* cited by examiner

*Primary Examiner*—Sebastiano Passaniti
(74) *Attorney, Agent, or Firm*—Aquilino, Welsh & Flaxman

(57) ABSTRACT

A method of making a truly balanced golf putter that is normally swung in a parabolic path during the execution of a putting stroke. The putter shaft is attached to a golf putter head. The exact center of gravity of the putter head is determined and the golf putter is dynamically swung in a parabolic path. The amount of rotation of the putter head is determined relative to a straight line along the parabolic path and the putter head and putter shaft are adjusted relative to each other by rotating the shaft with respect to the putter head until a perfect balance is achieved.

1 Claim, 2 Drawing Sheets

BIO-RHYTHM BALANCED PUTTER

BACKGROUND AND SUMMARY OF THE INVENTION

The present invention relates to putter type golf club heads and in particular to a golf putter having a superior balancing system.

In making a putter type golf club head, a putter that is truly balanced has long been recognized as desirable. Designs of clubs over the years have focused on various structures to provide more accurate golf shots with better control that have enhanced feel and playability. It is important to consider when making a balanced prototype golf club, that golfers have a wide variety of anatomical differences and dynamics in the way they swing a golf club, including the stroke that is made with a putter.

U.S. Pat. No. 4,866,979, to Bernhardt, discloses an apparatus for revealing the true balance of a putter dynamically as it is being swung. The putter is installed in a holder, drawn back and released. An unbalanced putter will turn in the holder revealing the unbalance.

U.S. Pat. No. 5,228,332, also to Bernhardt, provides a golf club with an improved balance by designing or selecting a particular shape and style of putter head and adding a putter shaft with a straight handle and an acute angle at the point where the shaft enters the club head. This enables the center of gravity to be accurately determined while the shaft is attached to the club head with a slow setting adhesive. Adjustments to compensate for rotation are made until a true balance is achieved. However, both Bernhart patents improperly assume that the putting strike is a pure pendulum motion whereas the actual putting motion is closer to a rhombus. As such, since Bernhardt's basic assumption regarding the path of a putting stroke is incorrect, the balancing technique disclosed in his patents yields undesirable and inaccurate results. A need, therefore, exists for a balancing technique which is reliable, simple and accurate. The present invention provides such a technique.

The present invention relates to a method for making a putter with an improved balance. The method of the present invention takes into consideration the human dynamics which alter a pure arcuate motion by maintaining the putter head at a fairly constant distance from the ground during both back swing and follow through. An ideal putting stroke by a golfer is one where the wrists are not breaking, the putter head is going straight back and straight through, and the putter head is moved parallel to the ground for a total length of between 1½ and 2 feet. This occurs because at a point when the shoulder pivot movement would normally be upward, there is a compensation movement by the shoulder vertical distance downward keeping the putter head close to the ground. The resulting swing movement is a rhombus and the path of a fixed point on the rhombus is a parabola rather than an arc, the portion of the parabola just behind and just in front of the ball being a nearly straight line whereby the club head is equidistant from the ground surface on the back swing and on the follow through during the execution of a putting stroke.

A putter assembled in accordance with the present invention includes a putter head, shaft and grip. The putter head typically weighs about 300–390 grams and the shaft and grip weighs about 100–160 grams. The center of gravity of the entire putter golf club is located on the shaft but close to the putter head. The exact center of gravity location may be determined by known mathematical formulas. Referring to the Bernhardt U.S. Pat. Nos. 4,866,979 and 5,228,332, which are incorporated herein by reference, a putter of the present invention is placed in a mechanical apparatus which is designed to swing the putter in a parabolic path. The amount of rotation is noted and the shaft is adjusted until a perfect balance is achieved. Because of the rhomboid movement of an actual putting stroke, rather than an arcuate movement, the toe of the putter may assume any position between plus and minus 45 degrees and still maintain balance unlike Bernhardt which must position the toe perfectly upright with no variation in the upright angle to achieve perfect balance.

An object of the present invention is the provision of a method of making a golf putter with a true balance.

Another object of the invention is the provision of a method of making a golf putter which is dynamically balanced in accordance with a rhomboid motion.

These and other object of the invention will become apparent from the following drawings and description.

The accompanying drawing incorporated in and forming a part of the specification, illustrates several aspects of the present invention, and together with the description search to explain the principles of the invention.

DESCRIPTION OF THE PREFERRED EMBODIMENT

Figure 2:
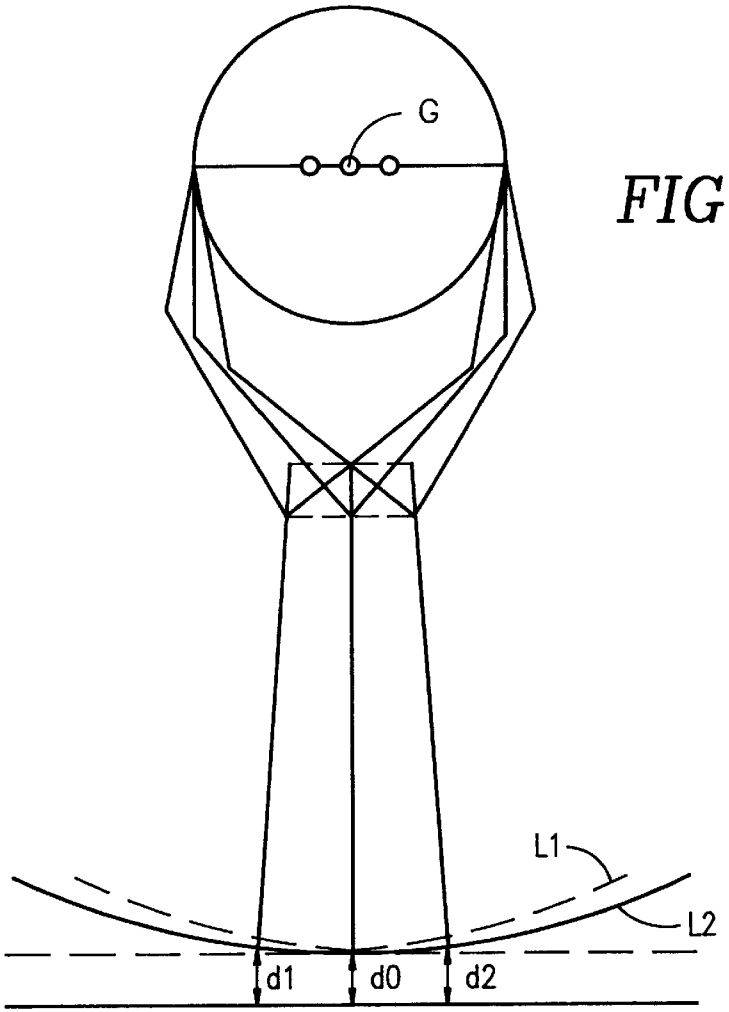
FIG. 2 illustrates a rhombus movement and a fixed point on the path of a rhombus is a parabola.
Figure 1:
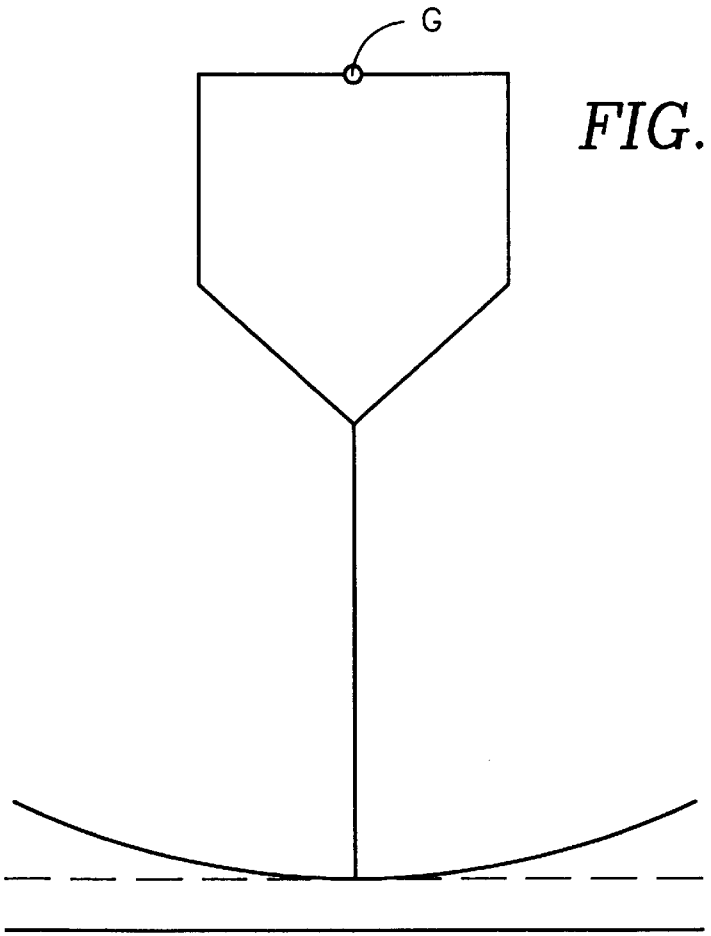
FIG. 1 demonstrates the arms, hands and shoulders of a golfer holding a golf club scribing an arcuate path.

The present invention is a method for making a putter with an improved balance which is an improvement over U.S. Pat. Nos. 4,866,979 and 5,228,332 to Bernhardt, which are incorporated herein by reference. FIG. 1 demonstrates the arms, hands and shoulders of a golfer G holding a golf club scribing an arcuate path. FIG. 2 illustrates the actual golf swing generated by most golfers which is not a pure pivotal motion or arcuate motion, but rather a rhombus movement. As can be seen from the drawing, the golfer attempts to keep the putter head relatively low to the ground both in the back swing portion and the follow through portion by moving the hands, arms and shoulders closer to the ground as the club head extends away from the ball in both the back swing and follow through mode. Thus the distance the club head is moved above the ground surface from address do to the extent of the back swing d1 and forward to the extent of the follow through d2 is essentially the same. This rhomboid movement creates a motion which is not arcuate, shown by dotted line L1, but parabolic as shown by the solid line L2. The present invention takes into consideration these human dynamics which alter a pure arcuate motion to a parabolic path. After assembling the putter head to the shaft and attaching a grip, the exact center of gravity of the head and the entire golf club may be obtained using known mathematical formulas.

Figure 3:
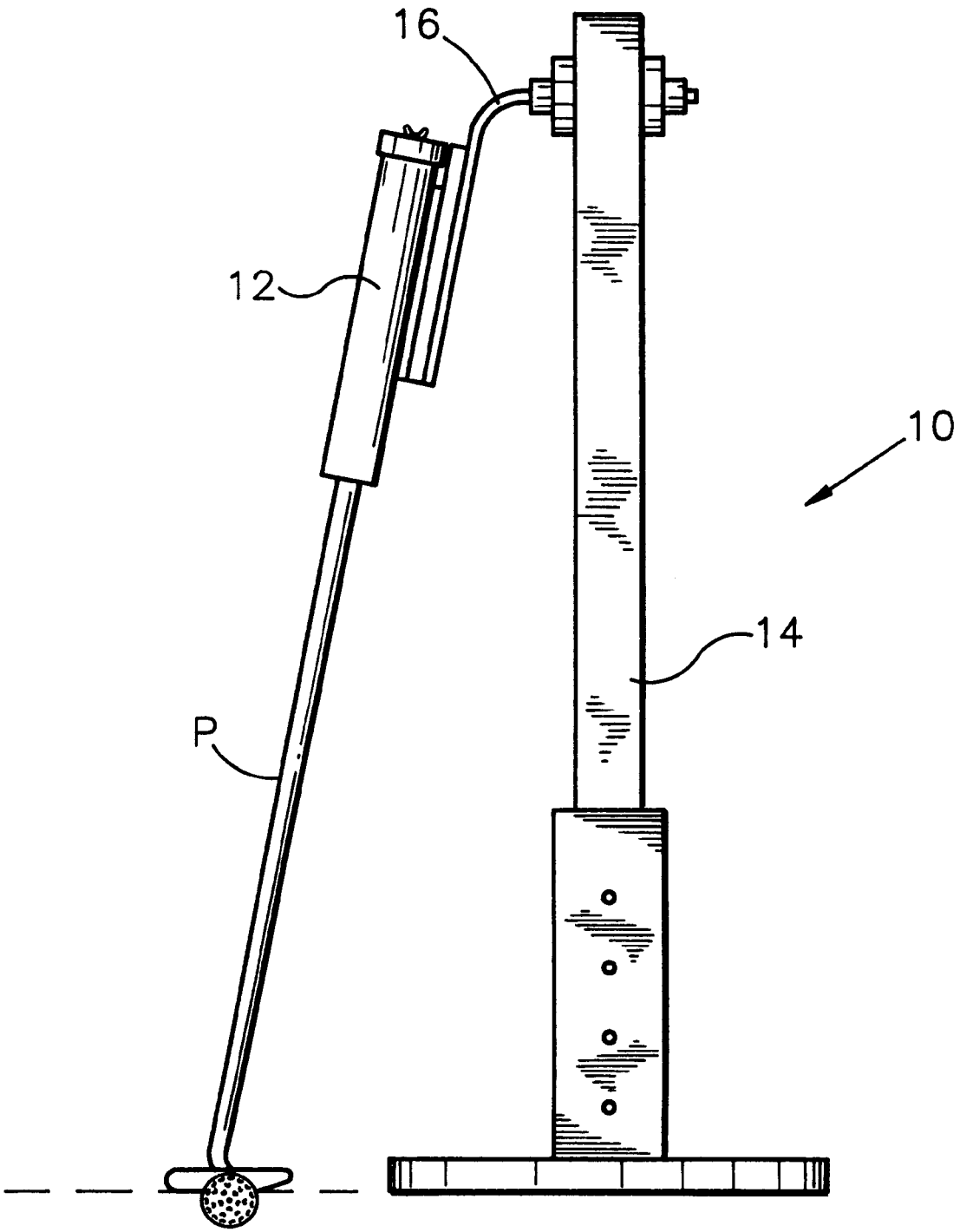
FIG. 3 illustrates an apparatus for swinging golf putters with a parabolic movement which accurately simulates a putter stroke.

FIG. 3 illustrates an apparatus 10 for swinging golf putters of the type shown in Bernhardt U.S. Pat. No. 4,866,979, with a parabolic movement which accurately simulates a putter stroke. The putter P, under examination, is installed in a holder 12 which is set at an inclined angle and attached to an upright support 14. A linkage 16 between the support and the putter holder 12 is designed to swing the putter P in a parabolic rather than an arcuate path. Therefore, as the putter P is drawn away and released, it swings in a parabolic path. If a true balance does not exist, the putter P will turn or rotate in the holder, confirming that the putter is not balanced when the putter is dynamically swung in a parabolic motion simulating a golf stroke motion.

In making a production golf putter, the shaft of the putter is joined to the head with a slow setting adhesive as disclosed in the Bernhardt patent. By adjusting the relative position of the putter head and shaft and retesting the putter with the parabolic swinging apparatus, it can be determined when a perfect balance is achieved.

It will be appreciated that once initial testing of putter balances are accomplished, an artisan making the putters will become accustomed to the exact amount of rotation necessary to balance the putter.

Thus, by simply testing the putters in a holder which allows longitudinal rotation during the execution of a swing in a parabolic path, the true balance of the putter may be achieved. Therefore, a golfer using a putter made in accordance with the present invention can be assured that the putter will not wobble or rotate due to putter imbalances, but will stay perfectly straight and in line as long as the proper stroke motion is made.

While various preferred embodiments have been shown and described, it will be understood that there is no intent to limit the invention by such disclosure, but rather, is intended to cover all modifications and alternate constructions falling within the spirit and scope of the invention as defined in the appended claims.

What is claimed is:

1. A method of manufacturing a golf putter with a true balance comprising:

attaching a golf putter shaft to a golf putter head whereby the shaft is movable relative to the head;

determining the exact center of gravity of the putter head;

dynamically swinging the golf putter in a parabolic path, the parabolic path being defined by a swing length which is between approximately 1½ feet to 2 feet and maintains the putter substantially parallel to a support surface for the length of the swing, wherein the swing replicates a golfer keeping the putter relatively low to the ground both in a back swing portion and a follow through portion by moving hands, arms and shoulders closer to the ground as the club head extends away from the ball in both the back swing portion and the follow through portion to create rhomboid movement; and determining the amount of rotation of the putter head relative to a straight line along said parabolic path and adjusting the putter head and putter shaft relative to each other by rotating the shaft with respect to the putter head until a perfect balance is achieved.

* * * * *